United States Patent [19]

Schroder

[11] 4,339,107

[45] Jul. 13, 1982

[54] WELL BLOWOUT PREVENTER PACKER ASSEMBLY AND PACKER MODULES THEREFOR

[75] Inventor: Steven L. Schroder, Buena Park, Calif.

[73] Assignee: Oil Tool Molded Products, Inc., Anaheim, Calif.

[21] Appl. No.: 293,685

[22] Filed: Aug. 17, 1981

[51] Int. Cl.[3] ..... B65D 53/00; E21B 33/06

[52] U.S. Cl. ..... 251/1 B; 277/115; 277/119; 277/188 A; 277/199; 277/235 R

[58] Field of Search ..... 251/1 R, 1 B; 277/115, 277/119, 122, 199, 235 R, 188 A

[56] References Cited

U.S. PATENT DOCUMENTS

| | | | |
|---|---|---|---|
| 1,045,088 | 11/1912 | Wriedt | 277/199 |
| 1,520,377 | 12/1924 | Washburn | 251/1 R |
| 2,555,647 | 6/1951 | King | 277/199 |
| 2,780,294 | 2/1957 | Loomis | 277/199 |
| 2,968,505 | 1/1961 | Scaramucci | 277/199 |
| 3,318,605 | 5/1967 | Brown | 277/199 |
| 3,323,773 | 6/1967 | Walker | 251/1 R |
| 3,486,759 | 12/1969 | Lewis | 166/84 |
| 3,591,125 | 7/1971 | Lewis | 277/199 |
| 3,728,041 | 4/1973 | Bertelson | 277/199 |
| 3,836,158 | 9/1974 | Davison et al. | 277/199 |

*Primary Examiner*—H. Jay Spiegel
*Attorney, Agent, or Firm*—Edward J. DaRin

[57] ABSTRACT

A well blowout preventer packer that is assembled by means of modularly constructed and defined elements. The modular elements are assembled and interlocked individually without resorting to cementing them together whereby individual elements may be replaced when they deteriorate. The modular packer elements can be molded individually so that the elastomeric materials can be better controlled.

9 Claims, 6 Drawing Figures

FIG. 4.
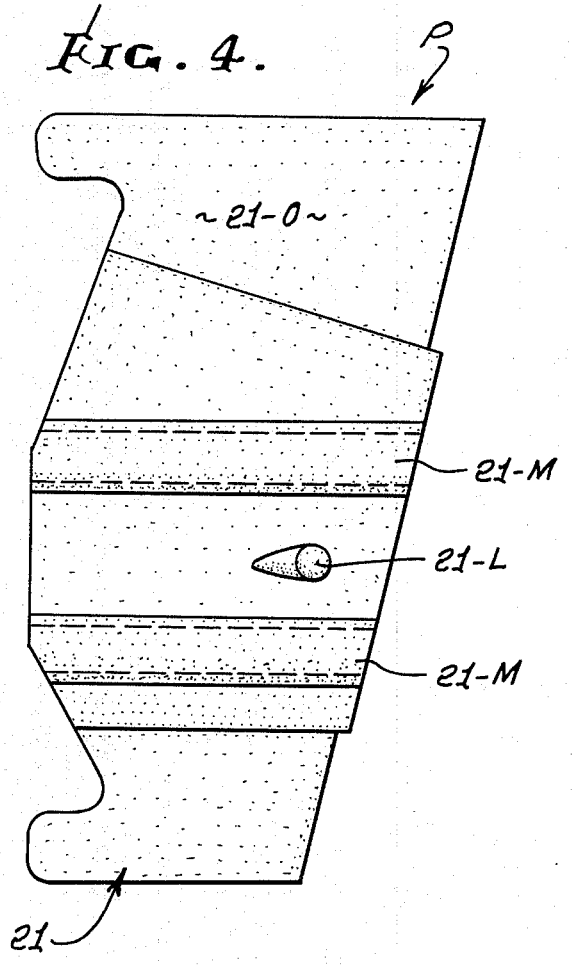
FIG. 5.
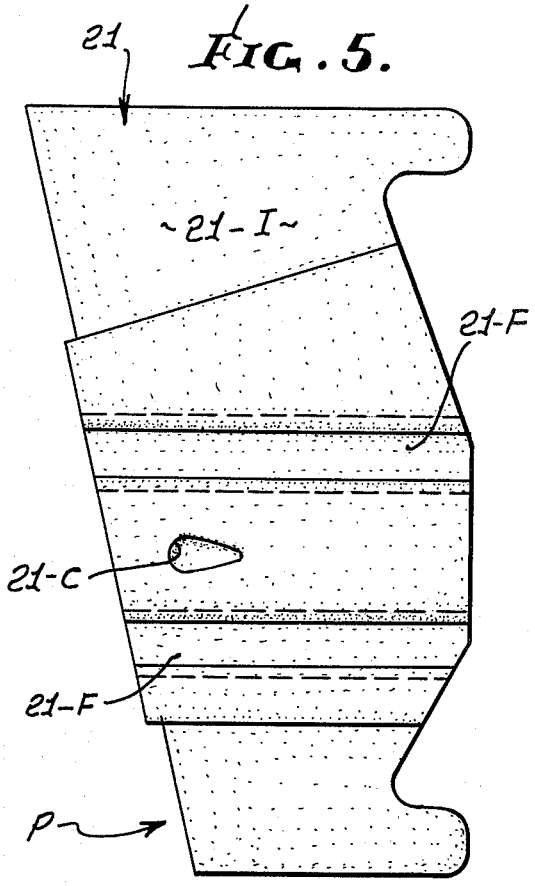
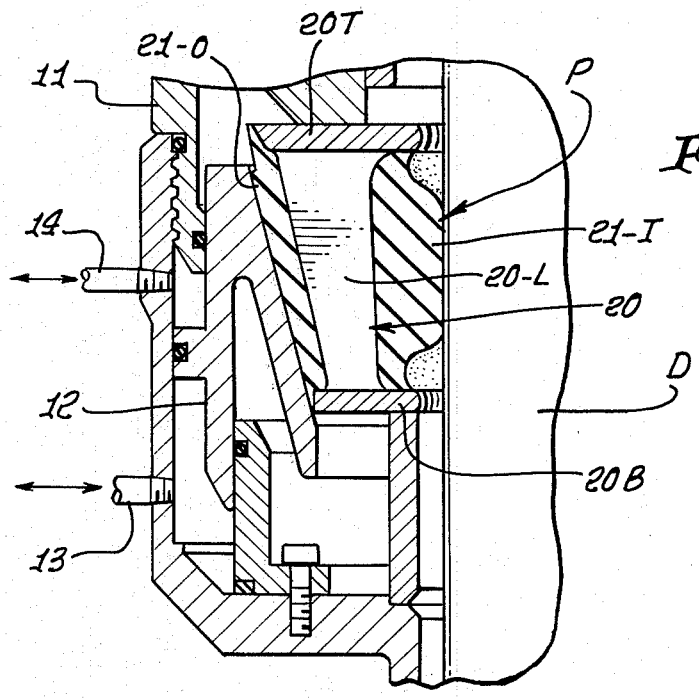
FIG. 6.

WELL BLOWOUT PREVENTER PACKER ASSEMBLY AND PACKER MODULES THEREFOR

FIELD OF THE INVENTION

This invention relates to well blowout preventer packer assemblies and more particularly to modular packer elements capable of being assembled in a blowout preventer.

BACKGROUND OF INVENTION

Well blowout preventer packer assemblies are well known in the art and are generally utilized during drilling operations where gas under pressure is present, or may develop. Generally, these packer assemblies are annular packing units that enable one to close off a hole around a drill pipe during drilling operations. The blowout preventer packer assemblies prevents oil blowouts, for example, when drilling for oil. Typical prior art units are disclosed in U.S. Pat. Nos. 1,045,088, 2,555,647; 2,780,294; 2,968,505; 3,318,605 and 3,591,125.

Generally, the prior art packing assemblies are molded in rubber as one annular piece and tend to break down. If the annular assembly breaks down, the entire unit must be replaced. The packer assembly disclosed in the aforementioned U.S. Pat. No. 3,591,125 is constructed of multiple elastomer body sections that are arranged in a side-by-side circular arrangement. Although this is a prior disclosure of interfitting body sections, in accordance with the teachings in the U.S. Pat. No. 3,591,125 patent, the sections are merely interfitted to facilitate bonding, or the cementing of the sections together. Once the elements are cemented together, they are then oven cured resulting in a unitary annular assembly and used as a unit as other prior art packers are and; therefore, have the same disadvantages as the prior art packer assemblies. The interfitting of the elements as disclosed in said U.S. Pat. No. 3,591,125 patent is merely to align the elements for the purpose of cementing them together. It should also be appreciated that in assembling the elements disclosed in patent U.S. Pat. No. 3,591,125, they cannot be assembled without cementing, as they would fall into the drilling aperture.

SUMMARY OF THE INVENTION

The present invention provides an improved, relatively inexpensive, well blowout preventer packer assembly that eliminates some of the problems of the aforementioned prior art devices. The present invention provides a packer assembly that is assembled in a blowout preventer from modular units that allow the assembly to be constructed element by element so that, if in use one element is destroyed, it can readily and solely be replaced to extend the life of the remaining units. The modular elements can be molded separately of rubber and, as a result, the molding process can be more easily controlled than when the entire unit must be molded. Individually molded elements are better controlled and exhibit a longer useful life. The modular units can be assembled into an annulus without the need of bonding the elements to each other, and yet provide a gas-tight relationship relative to the drill pipe, and relative to each other modular element. The modular elements are constructed of a preselected elastomeric material bonded to a reinforcing element so that the elastomer is responsive to compressive forces applied thereto to move into engagement with the drill pipe and to each other to provide the gas-tight relationship. The elements are maintained in the desired position solely through the provision of mechanical interlocking means. The arrangement of the interlocking means allows relative displacement to permit closing on irregular shaped objects, such as a square or hexagonal kelly.

From a structural standpoint, the present invention comprises a well blowout preventer packer wherein the combination comprises a plurality of reinforced elastomer elements, individually molded in one piece, for defining a central opening when the elements are assembled together in a side-by-side relationship in a substantially circular arrangement to function as a well blowout preventer packer. The circular arrangement of the elements are secured together mechanically without any additional bonding. Each of the plurality of modular elements are similarly defined. To this end, each modular element is constructed and defined in a wedge-like fashion with an inner elastomeric surface engageable with a pipe. Each modular element includes a reinforcing member extending substantially vertically of the element with the elastomeric material bonded and molded to the opposite sides of the reinforcing member. One side of the elastomeric material is constructed and defined with a radially extending interlocking means with the opposite side thereof having its elastomeric material constructed and defined with a complementary interlocking means whereby the aforementioned complementary interlocking means extend essentially the entire length of the opposite sides of the elastomeric material and are adapted to interfit with another modular element. One side of the elastomeric material includes locating locking means arranged at a preselected location intermediate the ends of each element with the opposite side of the elastomeric material having complementary locating means at a corresponding location intermediate the ends of the element. The elements can be assembled together by sliding the interlocking means at one element along the complementary interlocking means of another element arranged adjacent thereto until the locating means of one section locks into place at the complementary locating locking means of the adjacent element. When all of the elements are thus assembled together, the wedge-like shape of the elements in combination with the length of the locking channels and locking elements will prevent the elements from moving inwardly and downwardly and the secured locating locking means prevents the elements from normally moving outwardly.

These and other features of the present invention may be more fully appreciated when considered in the light of the following specification and drawings:

BRIEF DESCRIPTION OF THE DRAWINGS

FIG. 4 is a elevational view taken along the line 4—4 of FIG. 3;

FIG. 5 is an elevational view taken along the line 5—5 of FIG. 3; and FIG. 6 is a partial view of the blowout preventer illustrated in FIG. 1, with the compressive forces being applied to the packer elements.

DETAILED DESCRIPTION

Figure 1:
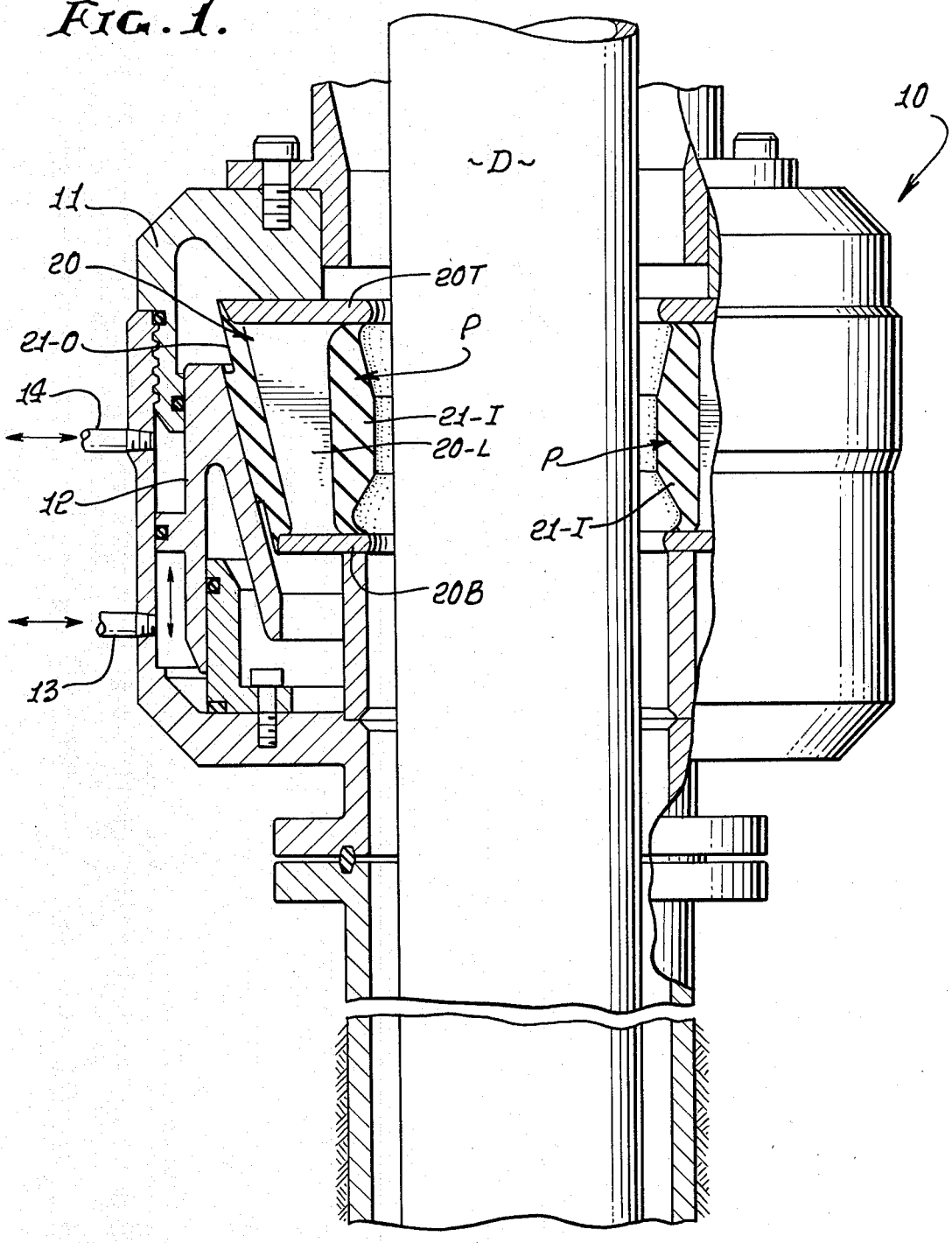
FIG. 1 is a vertical cross sectional view, with portions illustrated in elevation, showing the modular elements embodying the invention installed in a well blowout preventer.

Now referring to the drawings, the packer P of the present invention will be described in detail. The packer P will be initially examined as it is assembled in the conventional blowout preventer, as illustrated in FIG. 1. In FIG. 1, the packer P is illustrated in its normal or decompressed condition, or when it is spaced from a drill pipe shown in the form of the pipe D. The blowout preventer assembly 10 is of conventional construction and comprises a steel body 11 housing a movable piston 12. The packing element or packer P is mounted in the steel body 11 between the drill pipe D and the movable piston 12. The piston assembly is provided with the appropriate hydraulic seals, as illustrated, and is mounted to slide along the outer surface of the packer P in response to pressurized hydraulic fluid to compress the packer P against the drill pipe D. The compressive forces that are applied to the packer P are applied by means of pressurized hydraulic fluid coupled to suitable fittings 13 and 14 secured to the steel body 11, as illustrated in FIG. 1. To compress the packer P, the pressurized hydraulic fluid would be admitted into the body 11 at the fittings 13. With the application of pressurized hydraulic fluid at the fitting 13, the hydraulic fluid causes the piston 12 to move upwardly and, due to its internal taper, forces the packer P to be compressed inwardly against the drill pipe D. The resulting configuration of the packer P, when it is in a compressed condition relative to the drill pipe D, is illustrated in FIG. 6. When it is desired to relieve the hydraulic pressure from the steel body 11, the hydraulic fluid is relieved from fitting 13 and pressurized fluid is applied to the fitting 14 to apply sufficient pressure to the piston 12 to cause it to move downwardly and thus return the packing unit P to its original decompressed condition. It will be recognized that the configuration of the piston 12 is such that it has a portion that slidably engages the inner wall of the steel body 11. In this relationship, the hydraulic fluid entering into the body 11 is enclosed by means of the illustrated construction for the body 11 to pressurize the piston 12 to move it upwardly. In its final pressurized condition, the upper portion of the piston 12 defines a chamber between the inner wall of the body 11 and the point where the relieving pressure enters through the fitting 14 to sufficiently pressurize the piston 12 to cause it to travel back down to the position illustrated in FIG. 1 from that illustrated in FIG. 6.

Now referring to FIGS. 2 through 5, the detailed construction of the modular elements comprising the packer P will be described. The modular elements are defined with a metallic reinforcing member 20 having a substantially I cross-sectional configuration, as can best be appreciated from examining FIG. 3. The reinforcing means 20 is embedded in an elastomeric material 21-O and 21-I molded and bonded to the member 20 to completely surround the member, except for the top surface 20T and the bottom surface 20B. The elastomeric material may be rubber or the like. The left hand portion 21-O of the elastomeric material 21, as illustrated in FIG. 3, is defined with the male portion of a complementary interlocking means. A pair of male protrusions are identified by the reference characters 21-M and are arranged on the outside surface of the material 21-O in a spaced apart relationship intermediate the top and bottom ends of the material 21-O. The male protrusions 21-M extend essentially the entire length of the elastomeric material 21-O, as is evident from examining FIGS. 2 and 4. The elastomeric material 21-O is further provided with a locating, lockable means in the form of a male protrusion or detent 21-L that is illustrated as being located intermediate the interlocking members 21-M, see FIGS. 2 and 4. The location of the locking element 21-L is selected so as to allow a packing element P, arranged adjacent to another element to be longitudinally aligned when the locking element 21-L is locked to a coacting locking element.

The right hand portion of the elastomeric material 21 for the portion 21-I, is defined with the female interlocking channel 21-F arranged intermediate the top and bottom ends thereof extending essentially the entire length of the material 21-O; see FIGS. 3 and 5. The interlocking channels 21-F for the material 21-I are arranged in locations that correspond to the locations for the male interlocking members 21-M so that adjacent sections may be complementarily interlocked. Similarly, to accept the locating locking element 21-L, the elastomeric material 21-I is provided with an aperture that is complementary to the shape of the locking element 21-L and is identified by the reference numeral 21-C. The locating element 21-C is arranged in a location that corresponds to the location for the locking element 21-L so that when they are interfitted, the adjacent elements P of the packing unit are not only interlocked, but longitudinally aligned.

Figure 2:
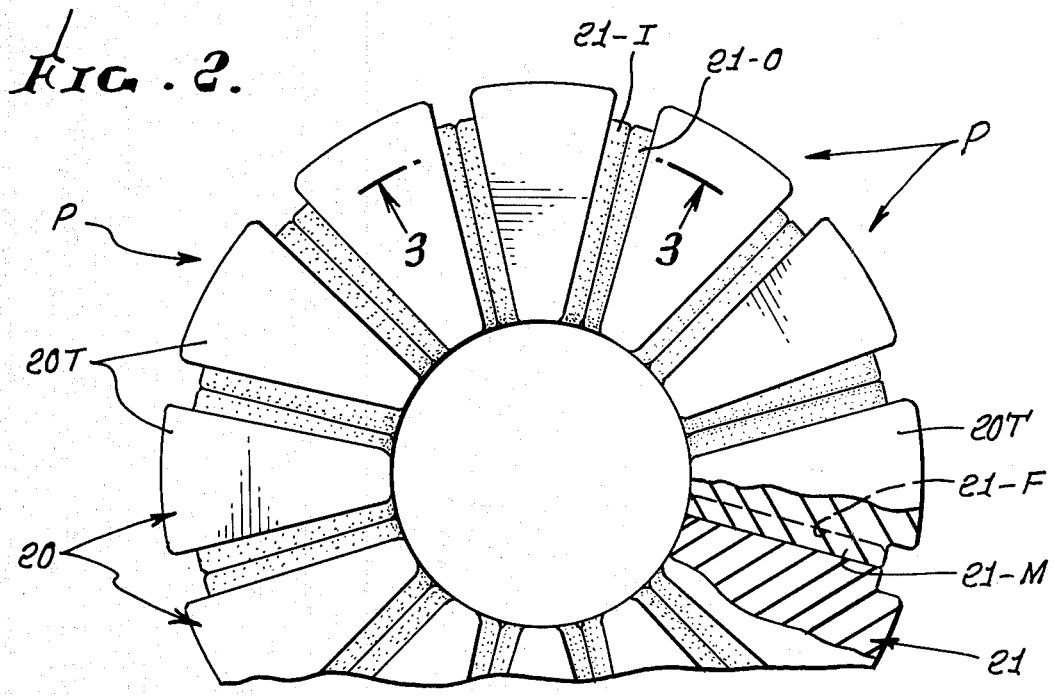
FIG. 2 is a partial top plan view of the assembled modular packing elements arranged in an annular configuration and embodying the present invention.
Figure 3:
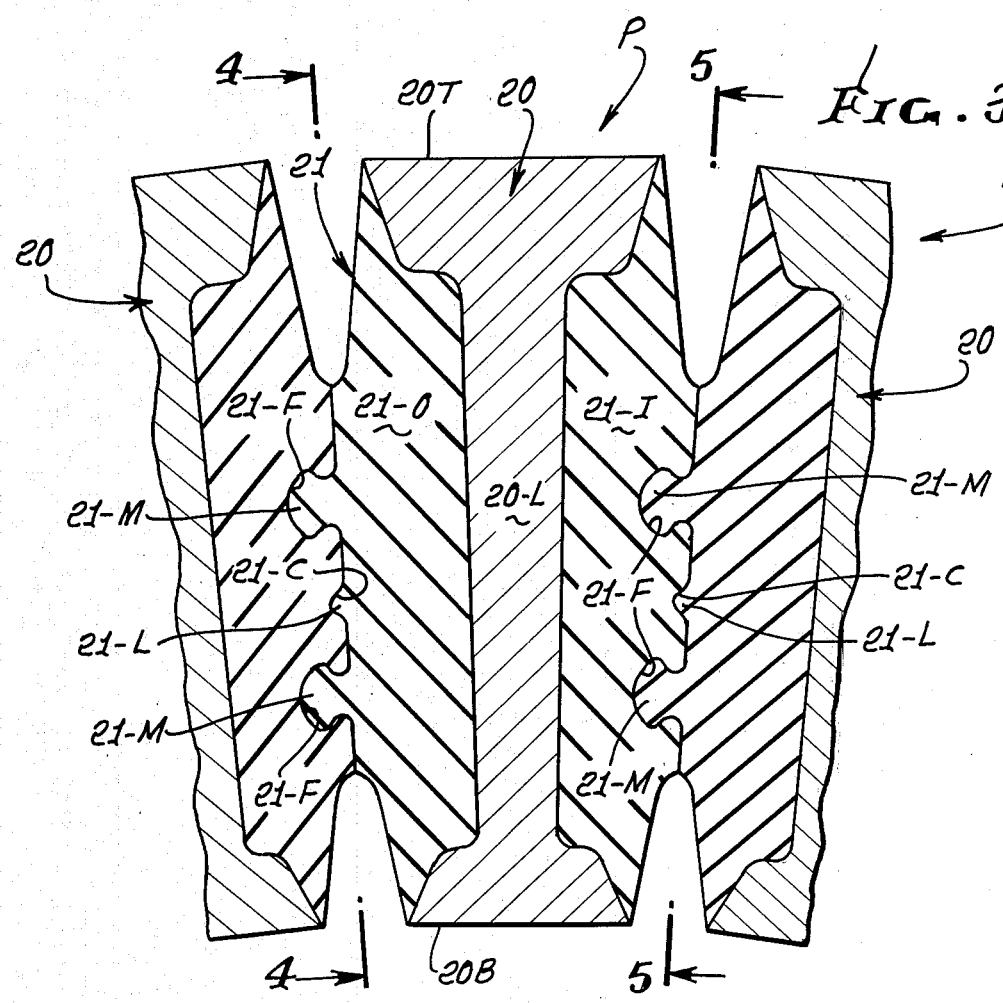
FIG. 3 is a sectional view taken along the line 3—3 of FIG. 2.

The metallic reinforcing element 20 which is illustrated in an I cross sectional configuration, has the top portion 20-T extending from the central leg 20-L of the element 20 and has a wedge-like configuration and extends essentially the entire length of the packer unit, as can be appreciated from examining FIGS. 1, 2 and 6. The bottom portion 20-B of the reinforcing element 20 is also the same general configuration, but is of a shorter length than the top portion 20-T, as is evident from examining the assembly in FIG. 1 and 6. The elastomeric material 21-O extends between the top 20-T and the bottom 20-B of the reinforcing element 20 and is inclined inwardly from the top to the bottom so as to abut the adjacent surface of the piston 12 for the well blowout preventer assembly 10.

With the above construction of the modular elements P in mind, the steps necessary for assembling the modules P can now be fully explained. It is recognized that all of the modular elements or packers P are constructed identically. When it is necessary to assemble the modules P they are placed so that a female interlocking portion 21-F for the adjacent module is interfitted with a corresponding male interlocking portion 21-F. With a pair of elements interfitted, the male elements 21-F are caused to slide along the channels 21-F until the locating locking element 21-L locks into its complementary locking element 21-C. Thus, then, will not only interlock a pair of adjacent packer units P, but will locate them longitudinally as a result of the location provided for the coating locating elements 21-L and 21-C. This procedure is repeated until the required member of elements are interlocked to complete the circular configuration of packers P, and as illustrated in FIG. 2, twelve modular elements P are so arranged.

The construction of the packer unit P is such that it is provided with a preselected taper and with a length of the interlocking elements 21-F and 21-M so as to prevent the modules P from moving inwardly. The provision of the locating locking devices 21-L and 21-C prevent the modules P from moving outwardly, unless an undue amount of force is applied.

It will now be recognized that this method of fabricating the packing modules P will provide an annular blowout preventer packer of superior performance with an ease of manufacture due to the ability to better control the molding process in a smaller modular unit P than when the unit has to be molded in its entirety. Also, in the event that there is a breakdown of any one of the packers P, it need merely be replaced, since no cementing has been resorted to to maintain the packers P in position. It should also be recognized that in the compressed condition of the element P, illustrated in FIG. 6, the relationship between the side wall of the well drill pipe D and the portions of the elastomeric material 21-I that engage the drill pipe D will be in a gas-tight relationship. Also, the interlocked packing units will have transmitted the compressive forces from the piston 12 to each other so as to maintain a gas-tight relationship between each of the interlocked packing units P so as to render the entire well blowout preventer assembly gas-tight as desired. The placement of the interlocking means axially of the element P permits relative displacement of the elements which is desirable when closing on an irregular object, such as a square or hexagonal kelly.

I claim:

1. In a well blowout preventer packer, the combination comprising a plurality of reinforced elastomer modular elements, individually molded, for defining a central opening when the elements are assembled together in a side-by-side relationship in a substantially circular arrangement to function as a well blowout preventer packer, the circular arrangement of the modular elements being secured together mechanically without any additional bonding, each of the plurality of elements being similarly defined, each element being constructed and defined in a wedge-like fashion and with each modular element including a reinforcing member extending substantially vertically in the element with an elastomeric material being bonded and molded to the reinforcing member to opposite sides thereof, one side of the element having the elastomeric material constructed and defined with radially extending interlocking means and the opposite sides of the element having the elastomeric material constructed and defined with a radially extending complementary interlocking means, the complementary interlocking means extending essentially the entire lengths of said sides and being adapted to interfit with one another, one side of the elastomeric material including a locating locking means arranged at a preselected location intermediate the ends of each section and the opposite elastomeric material having a complementary location locking means at a corresponding location intermediate the ends of the elements, the modular elements being assembled by sliding said interlocking means of one element along the complementary interlocking means of an another element until the locating locking means of one element locks into place at the complementary locating locking means of the another element whereby when the elements are all assembled together in a circular arrangement, the wedge-like shape of the elements in combination with the lengths of the interlocking channels and interlocking elements prevent the elements from moving inwardly and downwardly and the secured locating locking means prevents the elements from normally moving outwardly.

2. In a well blowout preventer packer as defined in claim 1 wherein said reinforcing member is a metallic member.

3. In a well blowout preventer packer as defined in claim 1 or 2 wherein said reinforcing member has a substantially I shaped cross-section and is bonded to the elastomeric material except for the top and bottom surfaces thereof.

4. In a well blowout preventer as defined in claim 1 wherein the elastomeric material is adapted to receive compressive forces transmitted thereto and to place the inner elastomeric materials in a gas-tight relationship with a piping member and being gas-tight in overall assembly when responding to the compressive forces.

5. In a well blowout preventer as defined in claim 4 wherein relative displacement is permitted between the interlocked elements when the sections are closed around an irregularly shaped member.

6. In a well blowout preventer as defined in claim 1 wherein said elastomeric material complementary interlocking means comprises a pair of vertically spaced locking channels on said one side and a pair of vertically spaced locking elements on said opposite side.

7. In a well blowout preventer as defined in claim 6 wherein said complementary locking means comprises a locking opening arranged intermediate said spaced locking channels and a complementary locking detent arranged intermediate the spaced locking elements to permit adjacent elements to be interfitted and interlocked to one another and thereby longitudinally aligned.

8. In a well blowout preventer packer as defined in claim 1 wherein said interlocking means comprises a locking channel and said complementary interlocking means comprises a locking element adapted to slidably engage the locking channel.

9. In a well blowout preventer packer as defined in claim 1 or 8 wherein said locating locking means and complementary locating locking means comprise a detent means and a detent opening defined on the elastomeric materials for locking engagement with one another.

* * * * *

UNITED STATES PATENT OFFICE

CERTIFICATE OF CORRECTION

Patent No. 4,339,107 Dated July 13, 1982

Inventor(s) Steven L. Schroder

It is certified that error appears in the above-identified patent and that said Letters Patent are hereby corrected as shown below:

Column 1, line 31, delete the word "patent";

Column 1, line 39, delete the word "patent";

Column 4, line 57, "Thus" should be changed to -- this --;

Column 4, line 62, "member" should be -- number --.

Signed and Sealed this

Second Day of November 1982

[SEAL]

*Attest:*

GERALD J. MOSSINGHOFF

*Attesting Officer* *Commissioner of Patents and Trademarks*